US011267004B2

(12) United States Patent
Rosko et al.

(10) Patent No.: US 11,267,004 B2
(45) Date of Patent: Mar. 8, 2022

(54) SPINNING SHOWERHEAD

(71) Applicant: Delta Faucet Company, Indianapolis, IN (US)

(72) Inventors: Michael Scot Rosko, Greenwood, IN (US); Thad J. Eads, Urbana, IN (US)

(73) Assignee: Delta Faucet Company, Indianapolis, IN (US)

( * ) Notice: Subject to any disclaimer, the term of this patent is extended or adjusted under 35 U.S.C. 154(b) by 129 days.

(21) Appl. No.: 16/561,733

(22) Filed: Sep. 5, 2019

(65) Prior Publication Data

US 2020/0086336 A1 Mar. 19, 2020

Related U.S. Application Data

(60) Provisional application No. 62/731,094, filed on Sep. 14, 2018.

(51) Int. Cl.

| | |
|---|---|
| ***B05B 3/04*** | (2006.01) |
| ***B05B 1/18*** | (2006.01) |
| ***F21S 9/04*** | (2006.01) |
| ***F21V 33/00*** | (2006.01) |
| ***B05B 1/20*** | (2006.01) |
| ***B05B 12/00*** | (2018.01) |

(52) U.S. Cl.

CPC ..... *B05B 3/0422* (2013.01); *B05B 1/18* (2013.01); *B05B 1/205* (2013.01); *B05B 3/0427* (2013.01); *B05B 12/004* (2013.01); *F21S 9/046* (2013.01); *F21V 33/004* (2013.01)

(58) Field of Classification Search

CPC ..... B05B 1/18; B05B 1/205; B05B 1/185; B05B 3/02; B05B 3/0422; B05B 3/0427; F21S 9/046; F21V 33/004

See application file for complete search history.

(56) References Cited

U.S. PATENT DOCUMENTS

| | | | | |
|---|---|---|---|---|
| 3,762,648 | A | 10/1973 | Deines et al. | |
| 4,068,801 | A * | 1/1978 | Leutheuser | B05B 1/1645 239/381 |
| 5,199,639 | A | 4/1993 | Kobayashi et al. | |
| 5,704,547 | A | 1/1998 | Golan et al. | |
| 6,719,218 | B2 | 4/2004 | Cool et al. | |
| 6,775,865 | B1 | 8/2004 | Lin | |
| 9,308,540 | B2 | 4/2016 | Alcamo | |
| 2006/0102747 | A1 | 5/2006 | Ho | |

(Continued)

FOREIGN PATENT DOCUMENTS

| | | | |
|---|---|---|---|
| CN | 2794647 | Y | 7/2006 |
| CN | 201052485 | Y | 4/2008 |

(Continued)

OTHER PUBLICATIONS

Machine Translation of the Specification and Claims of Chinese Publication No. CN201052485Y, Published Apr. 30, 2008, 5 pages.

(Continued)

*Primary Examiner* — Darren W Gorman

(74) *Attorney, Agent, or Firm* — Bose McKinney & Evans LLP

(57) ABSTRACT

A showerhead including an inlet fluid channel, a flow adaptor, an impeller, and an outer body having a plurality of first outlets. The outer body is rotatably supported such that the first outlets rotate about the inlet fluid channel.

16 Claims, 9 Drawing Sheets

(56) References Cited

U.S. PATENT DOCUMENTS

| | | | | |
|---|---|---|---|---|
| 2006/0255176 | A1 | 11/2006 | Yeiser | |
| 2008/0073449 | A1 | 3/2008 | Haynes et al. | |
| 2008/0282465 | A1* | 11/2008 | Shieh | B05B 3/0427 4/615 |
| 2010/0230512 | A1* | 9/2010 | Sato | B05B 3/008 239/225.1 |
| 2014/0268650 | A1* | 9/2014 | Tsai | F21V 33/004 362/96 |
| 2019/0351436 | A1* | 11/2019 | Kajuch | B05B 3/0427 |

FOREIGN PATENT DOCUMENTS

| | | | |
|---|---|---|---|
| CN | 101518760 | A | 9/2009 |
| CN | 101590455 | A | 12/2009 |
| CN | 204953158 | U | 1/2016 |
| TW | 360087 | U | 7/2009 |

OTHER PUBLICATIONS

Machine Translation of the Specification and Claims of Chinese Publication No. CN101590455A, Published Dec. 2, 2009, 5 pages.

* cited by examiner

SPINNING SHOWERHEAD

CROSS-REFERENCE TO RELATED APPLICATIONS

The present application claims priority to U.S. Provisional Patent Application Ser. No. 62/731,094, filed on Sep. 14, 2018, the disclosure of which is expressly incorporated herein by reference.

BACKGROUND AND SUMMARY OF THE DISCLOSURE

The present invention relates generally to showerheads. More particularly, the present invention relates to a showerhead including rotating components.

Adjustable showerheads are known in the art for providing pressurized water flow to a user. However, conventional showerheads may not provide the user with an effective spray pattern and aesthetically pleasing design. Furthermore, such showerheads may require a considerable amount of repositioning for the user, or may not provide sufficient spray coverage given water flow or pressure limits.

It is desired to provide a spinning showerhead with a spray pattern that provides improved coverage as it rotates, particularly with reduced water flow and/or pressure provided to the showerhead.

In one illustrative embodiment of the present disclosure, a showerhead includes an inlet fluid channel having a longitudinal axis, a flow adaptor fluidly coupled to the inlet fluid channel, and an impeller fluidly coupled to the flow adaptor and having a plurality of ribs. An outer body is coupled for rotation with the impeller and including a plurality of first outlets. The outer body and the impeller include multiple fluid outlets. The outer body is rotatably supported such that the fluid outlets of both the impeller and the outer body rotate about the longitudinal axis.

In a further illustrative embodiment of the present disclosure, a showerhead includes an inlet fluid channel having a longitudinal axis, and an impeller fluidly coupled to the inlet fluid channel and having a plurality of ribs. An outer body is fluidly coupled to the inlet fluid channel and includes a plurality of first outlets. A hydro-generator is fluidly coupled to the inlet fluid channel. The outer body is rotatably supported such that the first outlets rotate about the longitudinal axis of the inlet fluid channel.

In another illustrative embodiment of the present disclosure, a method for generating a shower spray pattern includes the steps of passing water from an inlet fluid channel into a flow adaptor, rotating water within the flow adaptor, contacting an impeller with the rotating water, and rotating an outer body by the impeller. The outer body has a plurality of first fluid outlets and sprays water out of the plurality of first fluid outlets such that the resulting shower spray pattern converges and subsequently diverges.

Additional features and advantages of the present invention will become apparent to those skilled in the art upon consideration of the following detailed descriptions of the illustrative embodiment best exemplifying the best mode of carrying out the invention as presently perceived.

BRIEF DESCRIPTION OF THE DRAWINGS

A detailed description of the drawings particularly refers to the accompanying figures in which.

DETAILED DESCRIPTION OF THE DRAWINGS

The embodiments of the invention described herein are not intended to be exhaustive or to limit the invention to the precise forms disclosed. Rather, the embodiments selected for description have been chosen to enable one skilled in the art to practice the invention.

Figure 1:
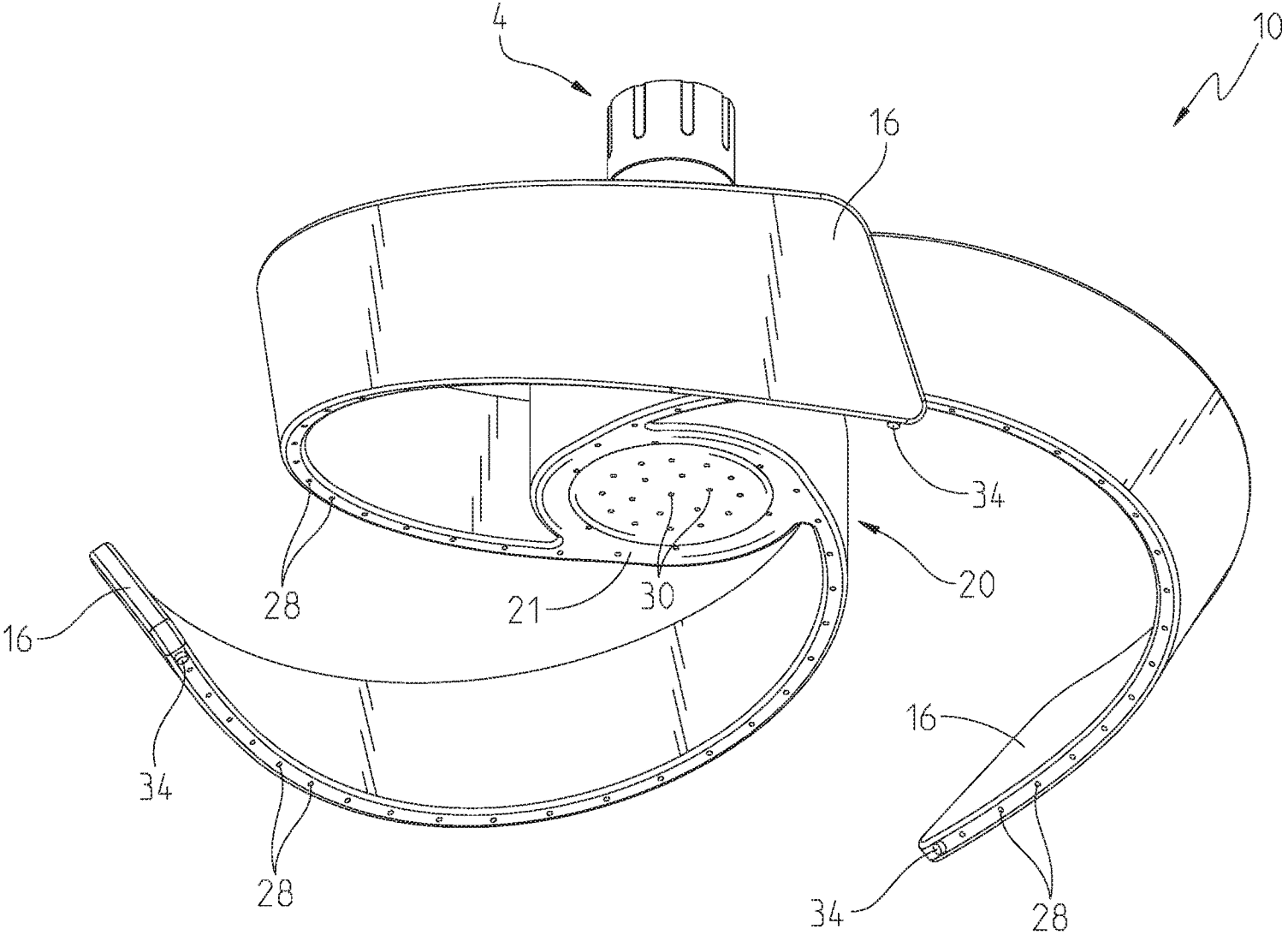
FIG. 1 is a perspective view of an exemplary showerhead of the present disclosure.
Figure 2:
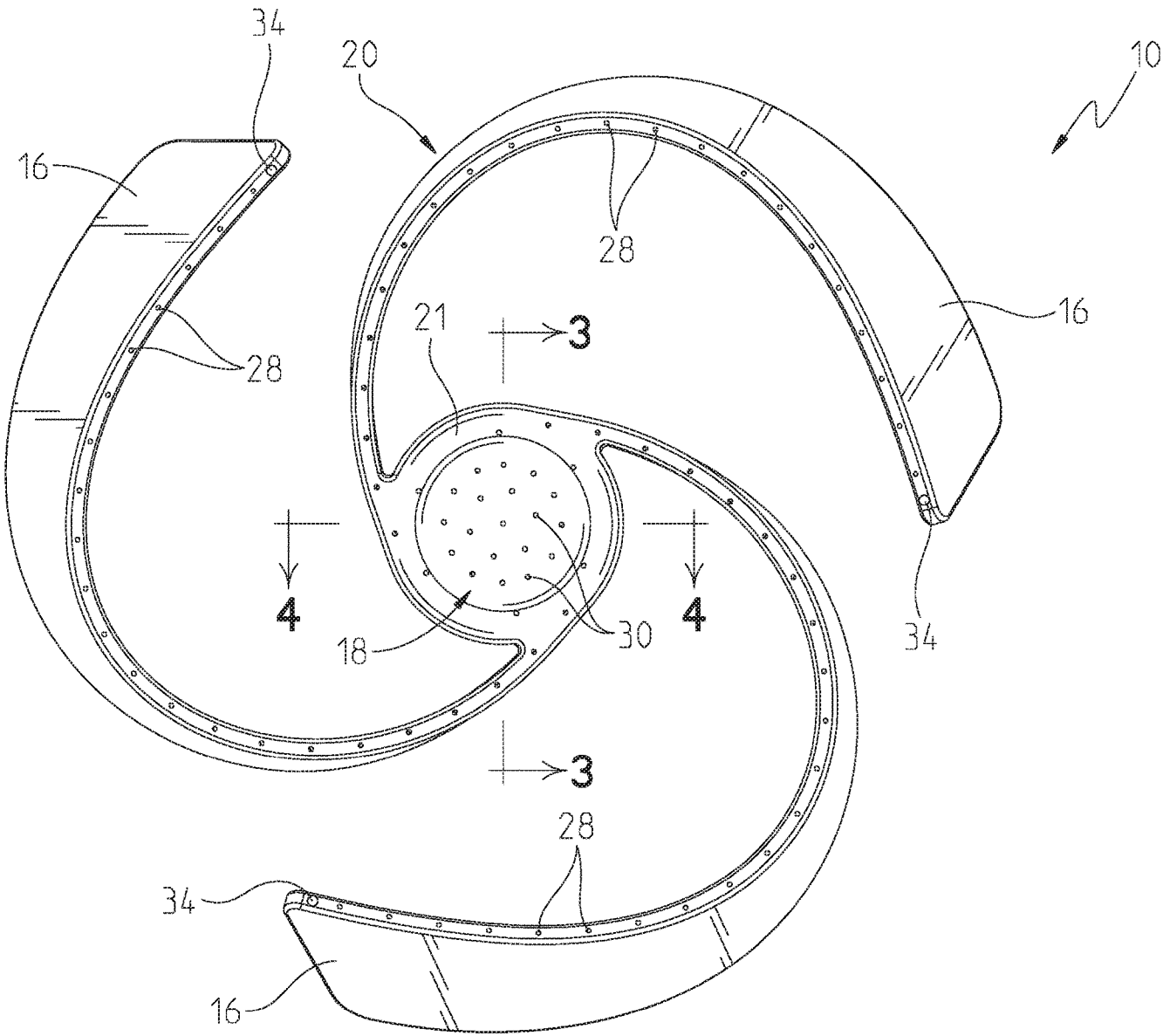
FIG. 2 is a bottom plan view of the showerhead of FIG. 2.

Referring initially to FIGS. 1-4, an illustrative showerhead 10 includes a ball and socket connection 4 configured to be fluidly coupled to a conventional shower arm to supply water from a water supply, such as a mixing valve (not shown). The ball and socket connection 4 fluidly couples to a flow adaptor 12, an impeller or rotor 18 and an outer body 20. FIG. 2 illustratively represents the outer body 20 supported by the impeller 18, and including a plurality of arcuate arms 16 extending tangentially outwardly from a cylindrical hub 21. A plurality of first fluid outlets 28 are formed within the arms 16 and are in fluid communication with an inlet channel 8 via the flow adaptor 12 and the impeller 18.

Figure 3:
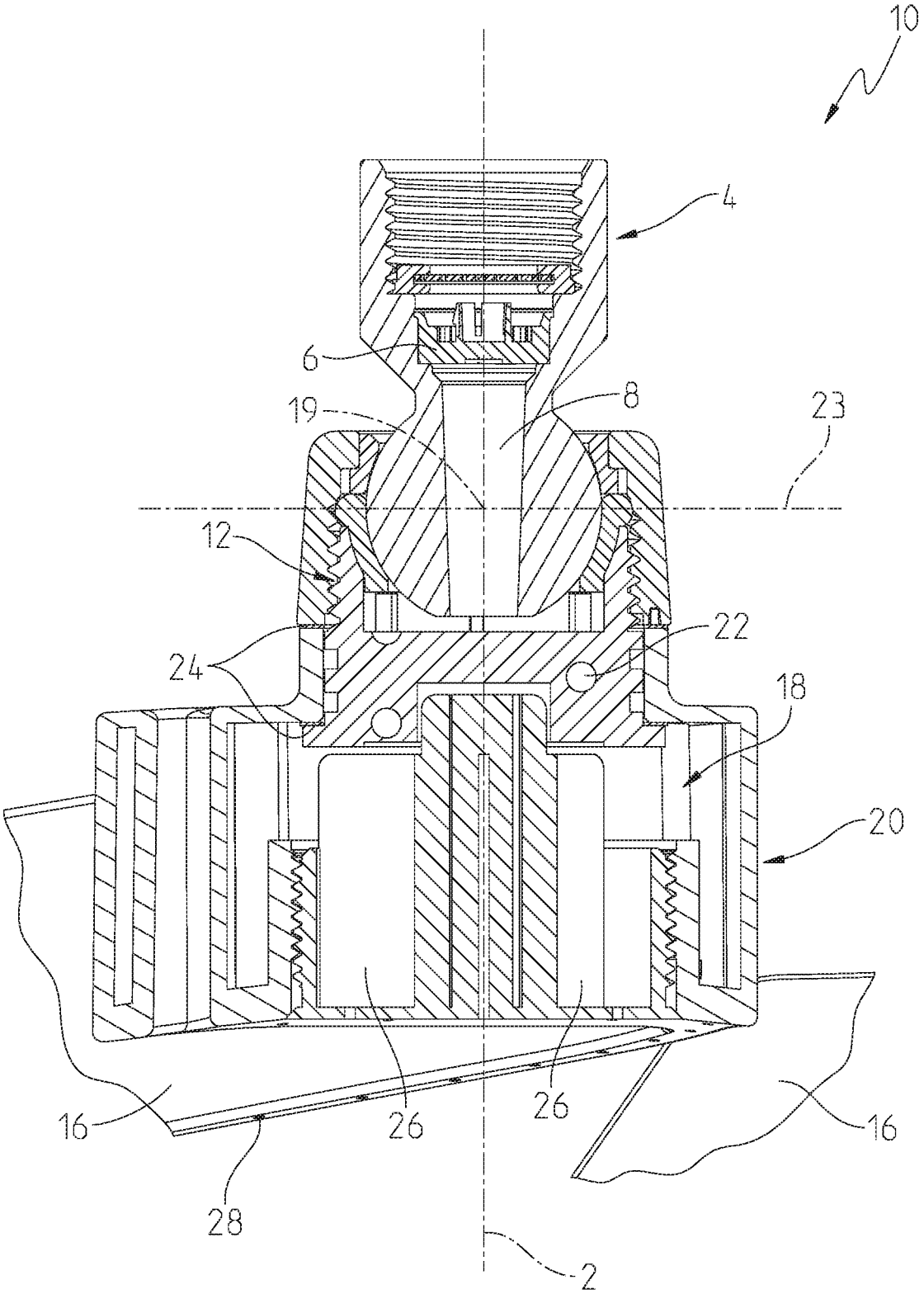
FIG. 3 is a cross-sectional view of the showerhead of FIG. 2 taken along line 3-3.
Figure 4:
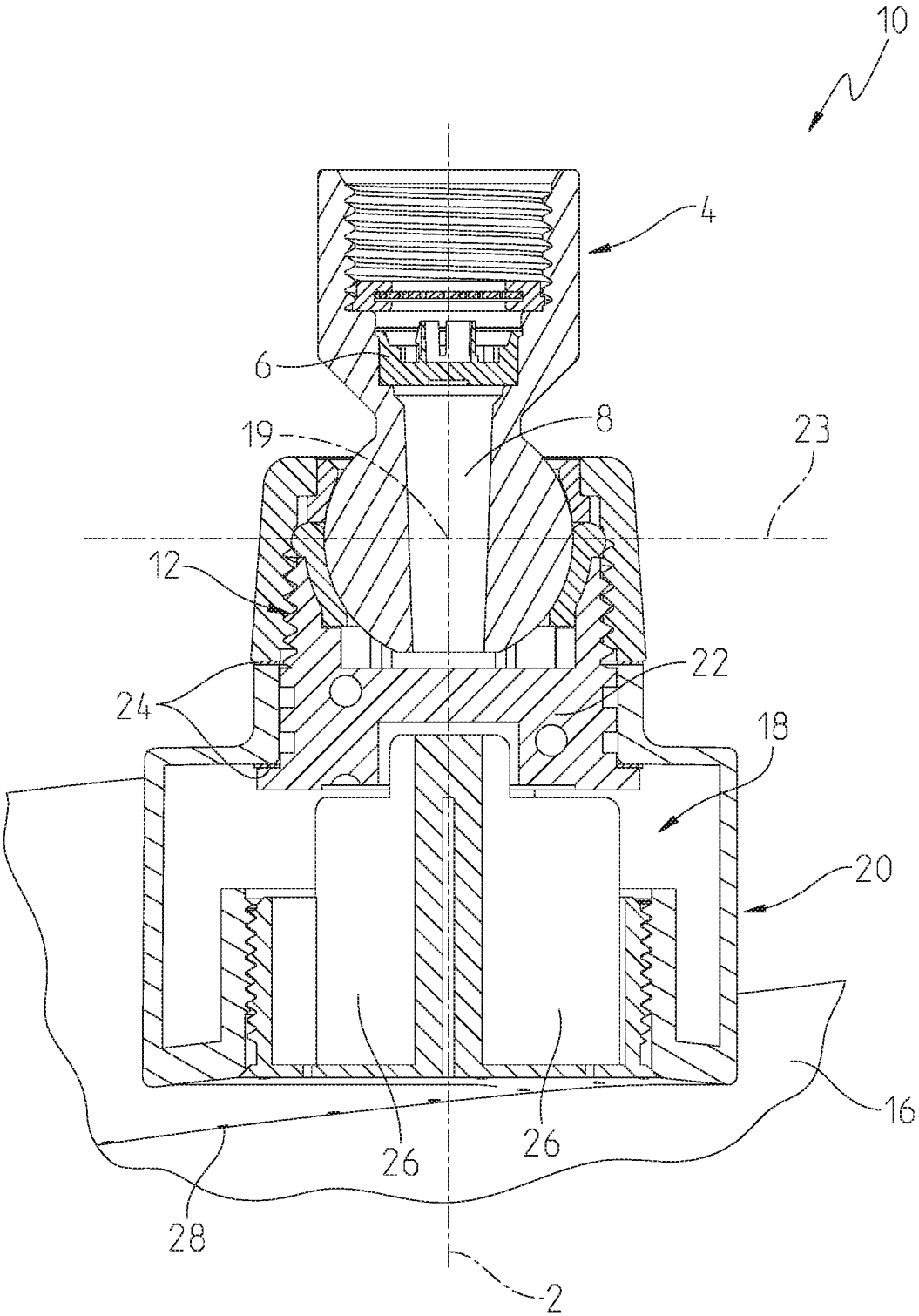
FIG. 4 is a cross-sectional view of the showerhead of FIG. 2 taken along line 4-4.

Referring further to FIGS. 3 and 4, the illustrative showerhead 10 includes the ball and socket connection 4, and fluidly connects to a flow regulator 6 which directs water through an inlet fluid channel 8 in order to limit or restrict flow and/or pressure of the water. In the illustrative embodiment, the showerhead 10 includes the inlet fluid channel 8, a flow adaptor 12, an impeller 18, and an outer body 20. The inlet fluid channel 8 is fluidly coupled to the flow adaptor 12 and may be defined by the ball and socket connection 4.

The flow adaptor 12 is configured to receive water from the inlet fluid channel 8 and provide water to the impeller 18. In the illustrated embodiment, the impeller 18 includes a plurality of ribs or vanes 26. The impeller 18 is configured to rotate about a longitudinal axis 2 as water contacts the plurality of ribs 26 from the flow adaptor 12. Furthermore, the outer body 20 is coupled to the impeller 18 such that outer body 20 rotates simultaneously with the impeller 18 about the longitudinal axis 2.

Figure 5:
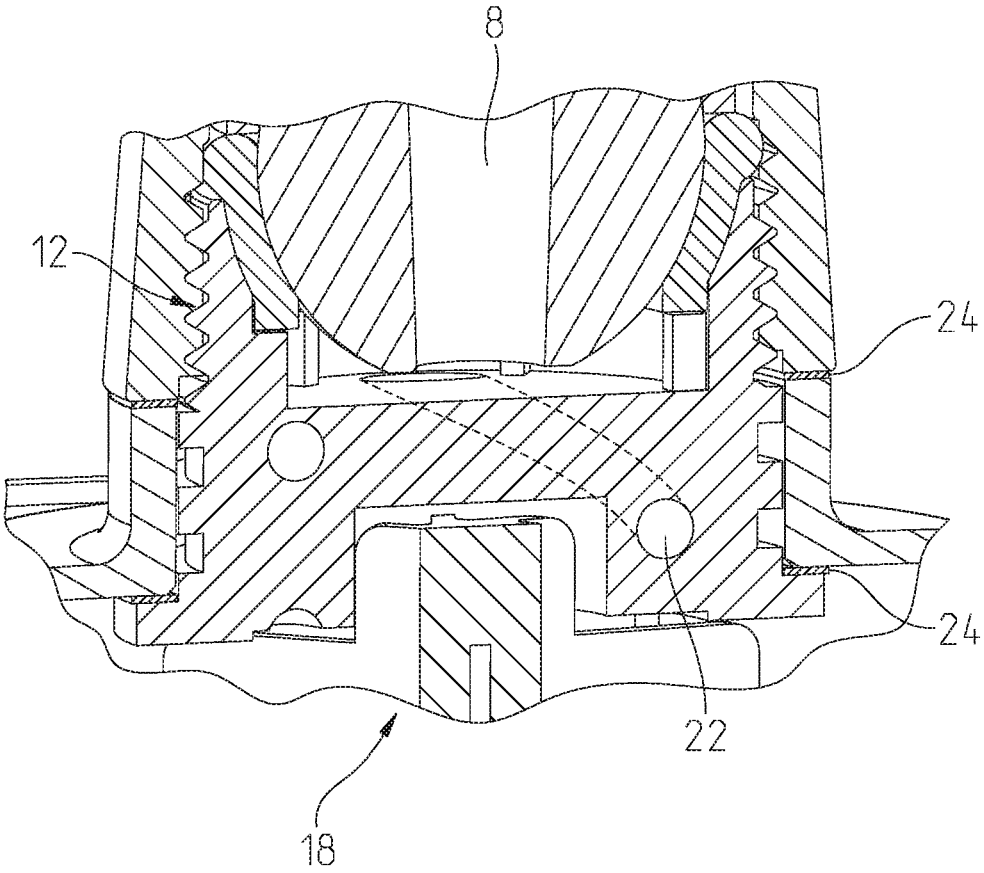
FIG. 5 is a detailed cross-sectional view of the flow adaptor of the showerhead of FIG. 4.
Figure 6:
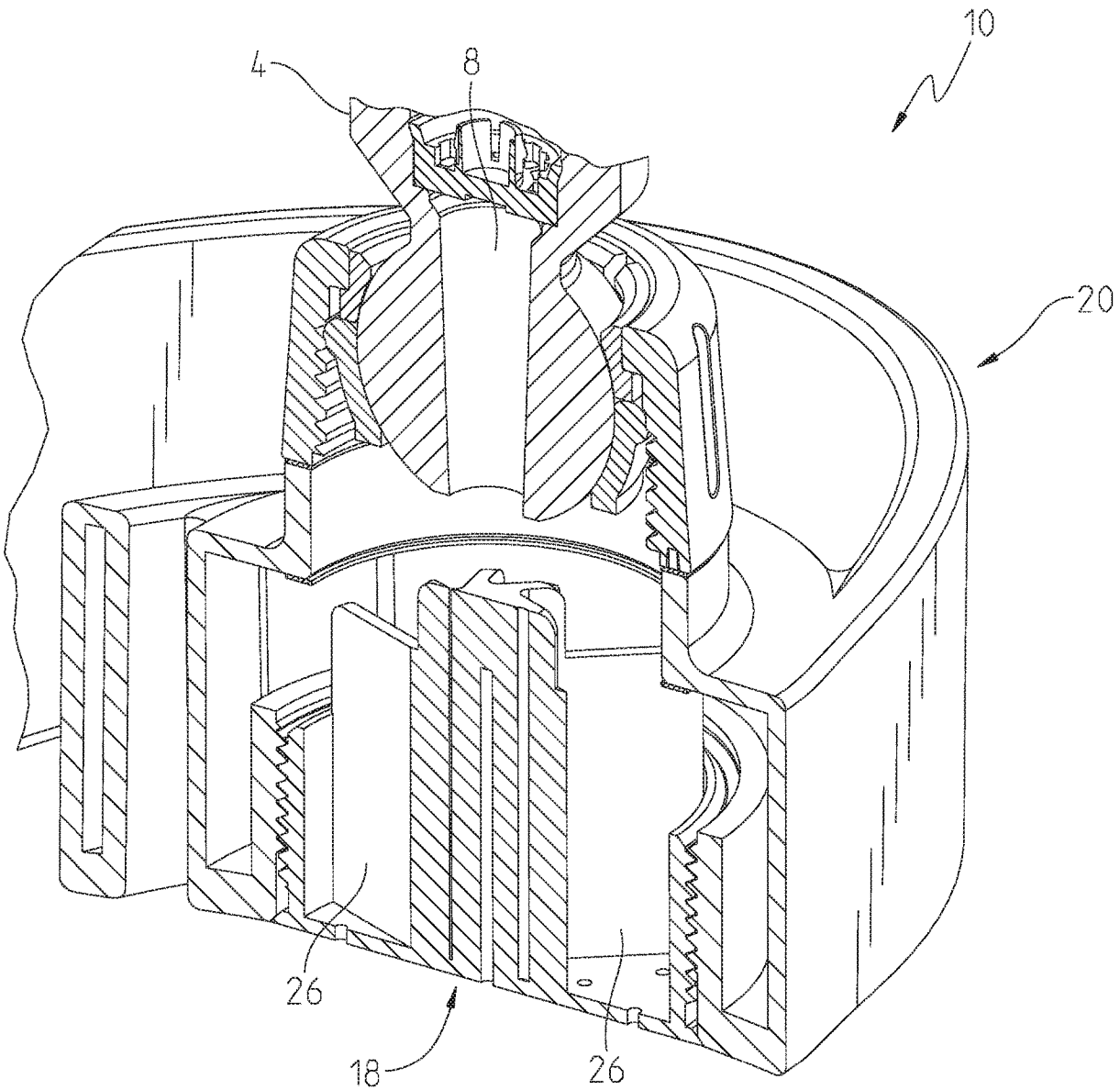
FIG. 6 is a perspective view in cross-section of the flow adaptor of FIG. 5.

Referring now to FIGS. 5 and 6, the showerhead 10 further comprises washers or bearings 24 (such as glide rings) coupled between outer body 20 and the flow adaptor 12 to reduce friction when rotary movement is present. The flow adaptor 12 further includes at least one angled, illustratively helical, passageway 22 (illustratively three as shown in FIGS. 5 and 7) fluidly coupled to the inlet fluid channel 8.

In the illustrative embodiment, the angled passageways 22 creates a pathway for water to pass through and extends from the top face of the flow adaptor 12 to the bottom face of the flow adaptor 12. Angled passageways 22 may bend, curve, straighten, and/or otherwise guide the water so that the water may move and contact the impeller 18 at any velocity or angle necessary. Illustratively, the angled passageways 22 cause the water to rotate or flow in spiral motion about the longitudinal axis 2. More particularly, the water is channeled by the passageways 22 into a helix to exit the bottom face of the flow adaptor 12 at an angle with high velocity. The flow adaptor 12 may be composed of rubber, plastic, or any other material suitable for fluid flow and may also be coated in a waterproof coating. The threads of impeller 18 and outer body 20 mate allowing both the impeller 18 and outer body 20 to rotate together when the ribs 26 are contacted by water.

Figure 7:
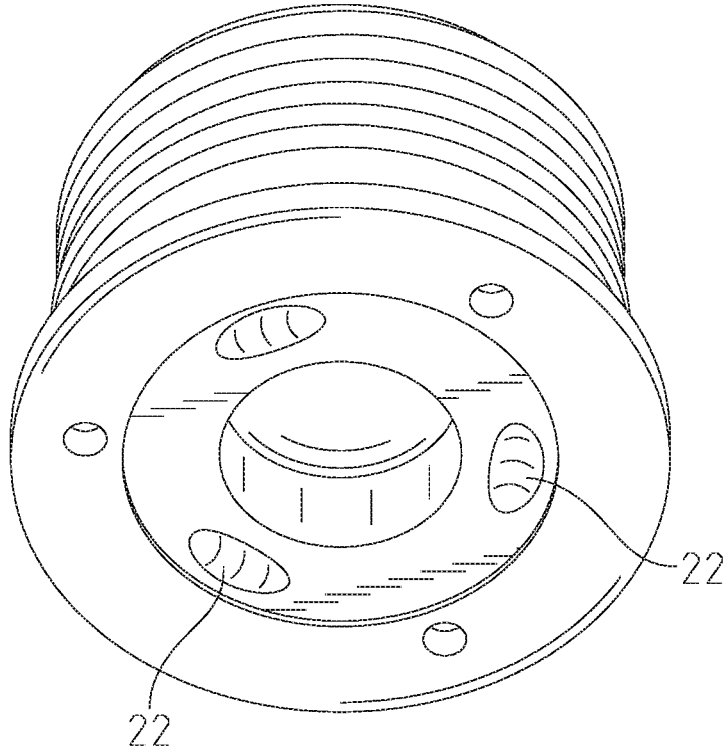
FIG. 7 is a perspective view of the flow adaptor of FIG. 1.
Figure 8:
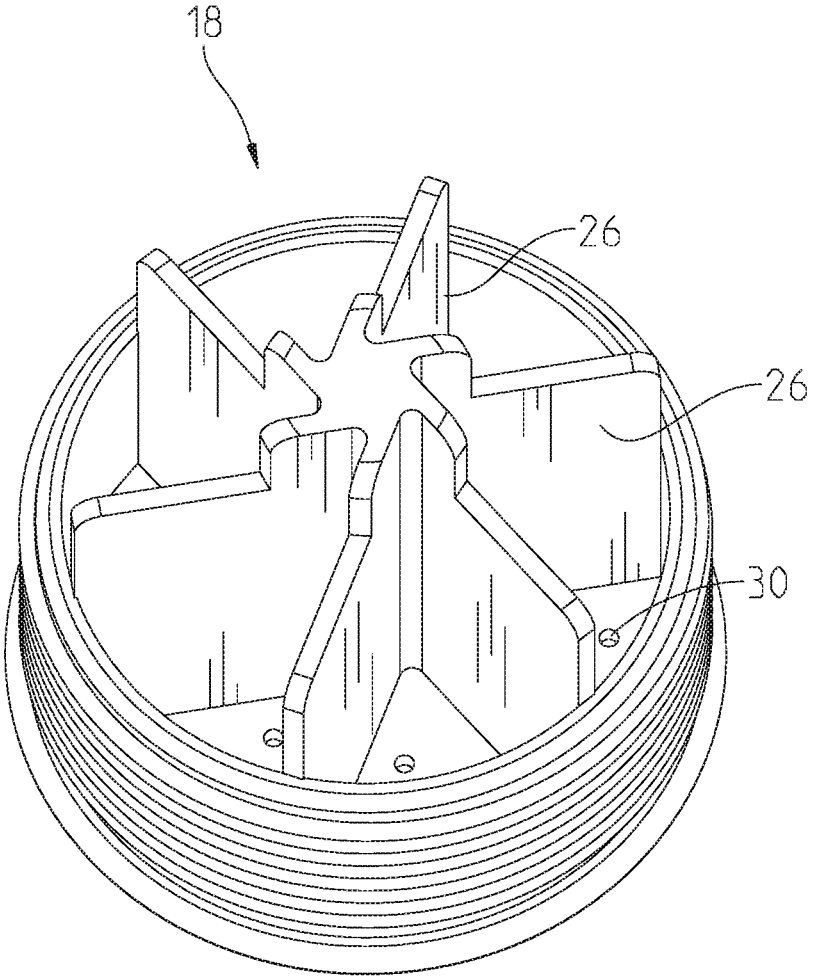
FIG. 8 is a perspective view of the impeller of FIG. 7.

With reference to FIGS. 7 and 8, the plurality of ribs or vanes 26 extend upwardly from the bottom face of the impeller 18 and parallel to the longitudinal axis 2. The bottom face of the impeller 18 illustratively includes a plurality of second fluid outlets 30. The plurality of second fluid outlets 30 illustratively rotate together with the impeller 18 and the plurality of the first fluid outlets 28 of the outer body 20.

Figure 9:
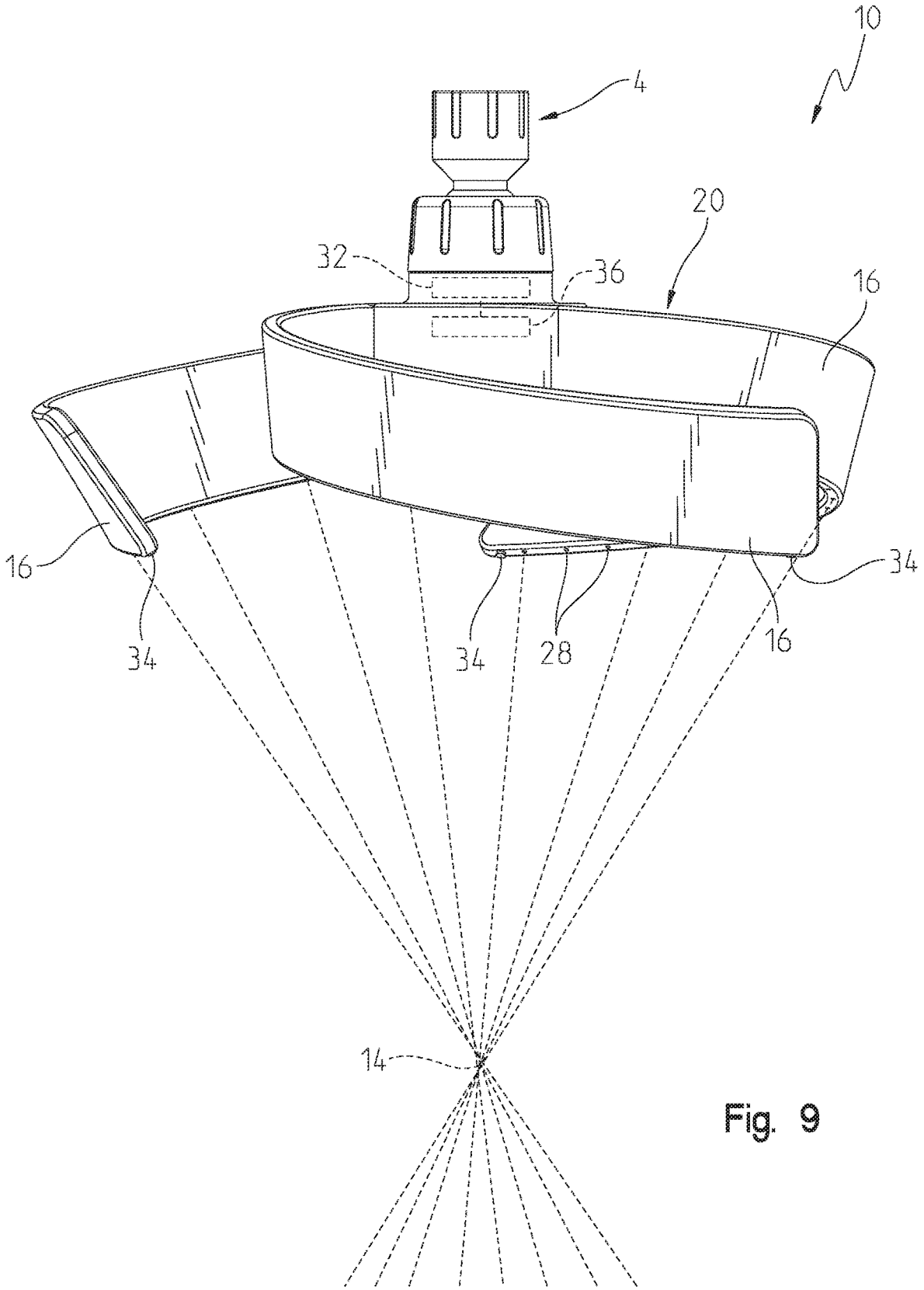
FIG. 9 is a side elevational view of the showerhead of FIG. 1, showing an operating spray pattern.

FIG. 9 illustratively represents operation of the outer body 20 of the showerhead 10, with the outer body 20 spinning (i.e., rotating about the longitudinal axis 2) in a clockwise or counter clockwise direction as a result of pressurized water supplied to the inlet fluid channel 8. The geometry and relative orientation of the fluid passageways 22 of the flow adaptor 12 and the cooperating ribs 26 of the impeller 18 will determine the direction of rotation (i.e., clockwise or counter clockwise). As the impeller 18 and the outer body 20 spin, the water discharged from the first fluid outlets 28 converge to a point 14 and then diverges, forming an enlarged spray pattern.

In the illustrative embodiment, the longitudinal axis 2 can be defined by a line extending from the center of the impeller 18. The ball and socket connection 4 allows the shower head to pivot about orthogonal axes 19, 23 (see FIG. 3).

As shown in FIG. 9, the illustrative embodiment may further include a hydro-generator 32 operably coupled to the impeller 18. More particularly, the hydrogenator 32 may be driven in rotation by the impeller 18 for generating electrical power. The energy generated by the hydro-generator 32 may be used to power one or more lights 34 (e.g., light emitting diodes (LEDs)) located on the bottom surface of impeller 18. The number and placement of the lights 34 may vary. Additionally, the lights 34 may be of different colors. In one illustrative embodiment, the lights 34 may be operably coupled to a temperature sensor in fluid communication with water passing through the showerhead 10 wherein the lights 34 change color based on different detected water temperatures. Additionally, the lights 34 may change intensity based upon water flow rate as detected by the hydro-generator 32.

It should be understood that other electrical devices could be supported by the showerhead 10 and powered by the hydro-generator 32. In one illustrative embodiment, an actuator, such as an electric motor 36, is in electrical communication with the hydro-generator 32. More particularly, the hydro-generator 32 could be used to power the electric motor 36 to start the spinning of the impeller 18 and/or the outer body 20. It is much more challenging to start rotation or spinning of the impeller 18 and/or outer body 20 than to keep it going. Illustratively, the motor 36 may start spinning of the showerhead 10 and the cooperating angled ribs 26 and passageways 22 maintain rotation. Alternatively, the motor 36 may keep the impeller 18 and/or outer body 20 rotating or spinning as a supplement to the cooperating angled ribs 26 and passageways 22.

In certain illustrative embodiments, the hydro-generator 32 may be used to power electronics for monitoring data (e.g., temperature, flow rate and/or volume dispensed). Illustratively, the hydro-generator 32 may be used to power an electrically operable diverter valve to change spray configurations (e.g., water flow to the first fluid outlets 28 and/or the second fluid outlets 30).

Figure 10:
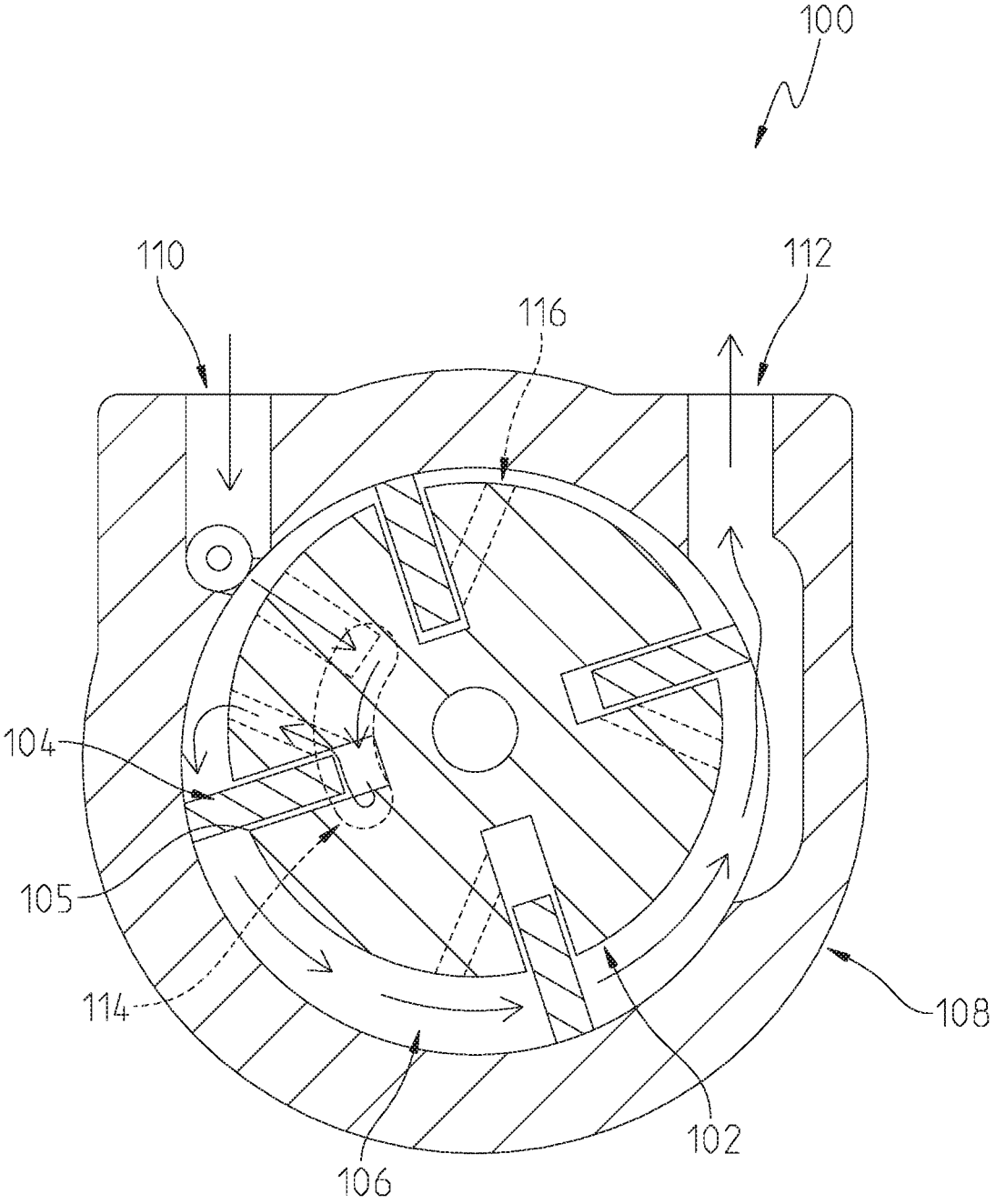
FIG. 10 is a schematic view of a further exemplary showerhead of the present disclosure.

An alternative illustrative showerhead 100 is shown in FIG. 10 where a differential pressure drop across opposing sides of a rotatable member may be used to cause the showerhead 100 to spin. More particularly, an impeller or rotor 102 may support a plurality of ribs or vanes 104 for radial sliding movement within rotor slots 105. The rotor 102 is eccentrically mounted within a fluid chamber 106 defined by a body 108, wherein the vanes 104 are spring biased radially outwardly. Pressurized water is provided at an inlet 110 while pressure at an outlet 112 is near atmosphere. At least one kidney shaped port 114 is illustratively provided in both end plates of the body 108, and holes 116 extend to the bottom of the rotor slots 105. A pressure drop is established across the vanes 104 as air travels between the inlet and the outlet.

Although the invention has been described in detail with reference to certain preferred embodiments, variations and modifications exist within the spirit and scope of the invention as described and defined in the following claims.

The invention claimed is:

1. A showerhead comprising:

an inlet fluid channel having a longitudinal axis;

a flow adaptor fluidly coupled to the inlet fluid channel;

an impeller fluidly coupled to the flow adaptor, the impeller having a bottom face and a plurality of ribs extending upwardly from the bottom face;

an outer body coupled for rotation with the impeller, the outer body having a plurality of outwardly extending arms, the outwardly extending arms including a plurality of first outlets;

wherein the outer body is rotatably supported such that the first outlets rotate about the longitudinal axis of the inlet fluid channel; and wherein the bottom face of the impeller includes a plurality of second outlets.

2. The showerhead of claim 1, wherein the outwardly extending arms define a partial helix.

3. The showerhead of claim 1, wherein the inlet fluid channel is coupled to a ball and socket connection.

4. The showerhead of claim 1, wherein the flow adaptor is configured to input rotary motion to water about the longitudinal axis.

5. The showerhead of claim 4, wherein the flow adaptor includes a helical passageway.

6. A showerhead comprising:

an inlet fluid channel having a longitudinal axis;

a flow adaptor fluidly coupled to the inlet fluid channel;

an impeller fluidly coupled to the flow adaptor and including a plurality of ribs; and an outer body coupled for rotation with the impeller and including a plurality of first outlets;

wherein the outer body is rotatably supported such that the first outlets rotate about the longitudinal axis of the inlet fluid channel; and wherein the outer body includes a plurality of radially extruding arms and wherein the plurality of radially extruding arms define a partial helix.

7. The showerhead of claim 6, wherein the impeller includes a plurality of second outlets.

8. The showerhead of claim 7, wherein the plurality of second outlets rotate about the longitudinal axis of the inlet fluid channel.

9. A showerhead comprising:

an inlet fluid channel having a longitudinal axis;

an impeller having a plurality of ribs, the impeller being fluidly coupled to the inlet fluid channel whereby fluid flow through the inlet fluid channel rotates the impeller;

an outer body fluidly coupled to the inlet fluid channel and including a plurality of first outlets;

a hydro-generator operably coupled to the impeller;

wherein the outer body is rotatably supported such that the first outlets rotate about the longitudinal axis of the inlet fluid channel; and a motor electrically coupled to the hydro-generator, and operably coupled to drive the outer body in rotation.

10. The showerhead of claim 9, further comprising a flow adaptor fluidly coupled to the inlet fluid channel.

11. The showerhead of claim 10, wherein the flow adaptor is configured to input rotary motion to water about the longitudinal axis.

12. The showerhead of claim 9, further comprising a plurality of lights operably coupled to the hydro-generator.

13. The showerhead of claim 12, wherein the lights are located on a bottom surface of the outer body.

14. The showerhead of claim 9, wherein the impeller includes a plurality of second outlets.

15. The showerhead of claim 14, wherein the plurality of second outlets rotate about the longitudinal axis of the inlet fluid channel.

16. The showerhead of claim 9, wherein the outer body includes a plurality of radially extruding arms.

* * * * *